United States Patent [19]

Griffith

[11] 4,389,172

[45] Jun. 21, 1983

[54] ROTARY COMPRESSOR OR EXPANSION ENGINE OF HYPOTROCHOIDAL CONFIGURATION AND ANGULARLY DISPLACED GEAR MEANS

[75] Inventor: Michael J. Griffith, Rutherford, N.J.

[73] Assignee: Curtiss-Wright Corporation, Wood-Ridge, N.J.

[21] Appl. No.: 198,583

[22] Filed: Oct. 20, 1980

[51] Int. Cl.[3] ..... F01C 1/22; F01C 19/00; F04C 18/22; F04C 27/00

[52] U.S. Cl. ..... 418/61 A

[58] Field of Search ..... 418/61 A, 125, 129

[56] References Cited

U.S. PATENT DOCUMENTS 3,465,729 9/1969 Jones ..... 418/61 A 4,012,180 3/1977 Berkowitz et al. ..... 418/61 A

FOREIGN PATENT DOCUMENTS 583035 12/1946 United Kingdom ..... 418/61 A

*Primary Examiner*—John J. Vrablik

*Attorney, Agent, or Firm*—Arthur L. Frederick

[57] ABSTRACT

The rotary compressor or expansion engine of the hypotrochoidal, two-lobe housing cavity type in which a rotor of a triangular profile is supported for planetative rotation within the housing cavity, has the meshing relationship of the timing gears angularly indexed slightly with respect to each other and from the theoretically desired position (where the apex portions of the rotor traces a path parallel to the inner surface of the housing cavity) so that the apex portions trace a path such that the apex portions are in close running-fit with the inner surface of the housing cavity in the area of highest pressure differential across the apex portions of the rotor.

2 Claims, 2 Drawing Figures supported in suitable bearings (not shown) in end walls 18 and 20. The rotor 16 is of a width which is substantially equal to the width of peripheral wall 22 so that side faces 28 are in close running-fit with the adjacent inner surfaces of end walls 18 and 20. The rotor defines with housing 12 a plurality working chambers A, B and C, each of which successively expand and contract in volumetric size as rotor 16 planetates within cavity 14 relative to housing 12.

The housing 12 of compressor 10 is provided with an intake port 40 and an exhaust or outlet port 42 on opposite sides of each of the junctures 26 so that gaseous fluid to be compressed passes into and compressed gaseous fluid is discharged from a working chamber associated with each lobe of cavity 14. In other words, for each complete rotation of crankshaft 36, there are two discharges of compressed gaseous fluid and for a compressor with a timing gear ratio of 3:2, the rotating speed of shaft 36 about its axis is equal to three times the rotating speed of rotor 16 about its axis so that for each revolution of the rotor there are six discharges of compressed air. Each of the outlet ports 42 is provided with a suitable check valve 44 which may be of the reed type schematically shown in FIG. 1. The check valve functions to prevent reexpansion of the compressed fluid into the following working chamber and will allow passage of compressed fluid only after a predetermined pressure differential value is achieved across the check valve. While the inlet ports 40 are shown as peripheral ports, that is located in peripheral wall 22, it is contemplated by this invention that, alternatively, the inlet ports can be located in one or both of the end walls 18 and 20 without departure from the scope and spirit of this invention.

The proper orientation of the rotor 16 and housing 12 is maintained in the well known member by a timing gear assembly comprising a meshing spur gear 46 and an internal ring gear 48. The spur gear 46 is constructed to surround shaft 36 and has a cylindrical hub portion with a flanged end 50 which abuts the outer surface of end wall 18. The spur gear 46 is secured in a fixed position by bolts 52 which pass through the flanged end 50 and are turned into threaded bores in end wall 18. The ring gear 48 is fixedly secured to the side face 28 of rotor 16 by bolts 54.

The efficient operation of compressor 10 is dependent upon achieving as optimum fluid-tight integrity of each working chamber A, B and C as possible commensurate with operational and cost limitations. Accordingly, compressor 10 has a seal grid system comprising a sealing bar 56 mounted for reciprocative movement in a slot at each juncture 26 of peripheral wall 22. Also, a seal ring 58 is carried in each side face 28 of rotor 16 to seal the interstices between each side face 28 and the adjacent inner surface of end walls 18 and 20. The sealing at the apex portions 32 is achieved by providing a close running fit between each of the apex portions 32 and peripheral surface 24 and optimizing that close running fit in accordance with this invention as hereinafter fully explained.

The rotor 16 and housing 12 are dimensioned so that the apex portions 32 of the rotor traverses a line which in the prior art is substantially parallel to the surface 24 of peripheral wall 22. This parallelism is necessary to allow for the normal machining tolerances and prevent binding of the rotor on the housing or the development of undesirable high friction therebetween. To minimize the blow-by of gaseous fluid past apex portions 32 in the quadrants of rotor travel generally designated as the angles L and B′ and defined, in general, as between the major and minor axes X—X and Y—Y of the housing, the pressure differential across each apex portion 32 is greatest in value in the quadrants designated L, while the lesser differential pressure across each apex portion 32 is in the quadrants identified as B′. The greatest differential pressure across apex portions 32 is in the quadrant L because of the compression of gaseous fluid in the working chambers communicating with outlet ports 42, as for example chamber C. The pressure differential across junctures 26 is also relatively high in value, but gaseous fluid blow-by is prevented by sealing bars 56. To minimize gaseous fluid blow-by of apex portions 32 during travel through quadrants L, the normal or theoretical orientation of housing 12 and rotor 16 is changed by changing the relative meshing positions of spur gear 46 and ring gear 48. More specifically, the change in angular relationship of the spur gear 46 to ring gear 48 from the theoretical positions, when the apex portions trace a path substantially parallel to surface 24 of peripheral wall 22, is effected by rotatively indexing spur gear 46 about its axis S by a slight angular amount and in a direction counter to the direction of rotor rotation which has the effect of displacing or rotating the minor axis Y—Y of housing 12 to the position Y′—Y′ as is indicated in FIG. 1. The spur gear is then bolted to side wall 18 in this position. This results in placing the rotor and housing in a relative position to each other so that the trace or line of travel of apex portions 32 of rotor 16 traverses a path indicated by the broken line 60. As is shown in exaggeration by broken line 60 in FIG. 1, the path of travel of apex portions 32 is closer to inner housing surface 24 in the quadrants L where the differential pressure across the apex portions is greatest, but the apex portions 32 travel further away from housing surface 24 in the quadrants B′ where the differential pressure across apex portions 32 is relatively small and where blow-by of gaseous fluid does not have a material effect on the efficiency of the compressor. By minimizing blow-by at the apex portions in quadrants L, while allowing greater blow-by of gaseous fluid in the quadrants B′, an increase in overall sealing effectiveness and, hence efficiency is nonetheless achieved.

As shown schematically in FIG. 2, this aforedescribed improved relative position of rotor and housing can be achieved by angular displacement of spur gear 46 as above described in detail or by angular displacement or indexing of ring gear 48 and rotor about its axis the same slight angular distance $\theta$, as for example in the order of about one degree (1°), relative to spur gear 46 and housing 12. Of course, both the spur gear 48 and ring gear 46 and its rotor 16 can be angularly moved about their respective axes S and R so that the combined angular displacement equals an amount of the angle $\theta$.

It is believed now readily apparent that the present invention provides a rotary piston compressor or expansion engine of the two-lobe hypotrochoidal type which is relatively inexpensive since it requires no seals carried in the apex portions of the rotor and is relatively efficient by reason of improved sealing effectiveness at the apex portions across which the greatest differential pressure exists during operation of the compressor or expansion engine.

Although but one embodiment of the invention has been illustrated and described in detail, it is to be expressly understood that the invention is not limited

ROTARY COMPRESSOR OR EXPANSION ENGINE OF HYPOTROCHOIDAL CONFIGURATION AND ANGULARLY DISPLACED GEAR MEANS

BACKGROUND OF THE INVENTION

This invention relates to rotary compressors and expansion engines and, more specifically, to compressors and expansion engines of the type which have a rotor supported for planetary movement within a housing and wherein the rotor has a peripheral surface forming a profile of hypotrochoidal configuration and the housing inner surface that is substantially the outer envelope traced by the rotor upon relative rotary motion of the rotor. Such a compressor or expansion engine is disclosed in British Pat. No. 583,035 granted Dec. 5, 1946 to Maillard and the U.S. Pat. No. 4,012,180, dated Mar. 15, 1977, and is generally known as a Maillard-type compressor or engine. The invention will herein be described in terms of a compressor and its operation although, as will be apparent, it also has application to expansion engines.

The efficiency of a rotary compressor depends upon the provision of adequate sealing of each of the working chambers, one from the other. Accordingly, in a Maillard type compressor, it is desirable to provide as effective a sealing as possible between each rotor nose portion and the inner peripheral surface of the housing. Such sealing is particularly difficult in the Maillard type compressor because the line of sealing shifts about the rounded nose portion as the rotor rotates relative to the housing. The use of a seal bar carried in a slot extending across the nose portions of the rotor, as is done in an epitrochoidal rotary mechanism, is not a practical solution to the problem of effectively sealing a Maillard type compressor. Other solutions are exemplified in the aforesaid U.S. Pat. No. 4,012,180 directed to labyrinth seals, the U.S. Pat. to Berkowitz, No. 4,018,548 dated Apr. 19, 1977 directed to an elastic sealing surface on the inner peripheral surface of the housing and the U.S. Pat. No. 4,043,714 dated Aug. 23, 1977 to Berkowitz directed to an expandable and retractable plate type seal covering each nose portion of a rotor. All of these solutions are relatively expensive and unsuitable for relatively inexpensive compressors.

Accordingly, it is an object of this invention to provide a relatively inexpensive and efficient compressor of the Maillard type.

Another object of the present invention is to provide a Maillard type compressor wherein efficiency is attained without sealing devices carried in the nose portions of the rotor.

SUMMARY OF THE INVENTION

It is, therefore, contemplated by the present invention to provide a compressor or expansion engine of the Maillard type which does not have sealing devices carried in the nose of the rotor and wherein the timing gears are slightly indexed relative to each other so that the rotor is slightly angularly advanced with respect to the direction of rotor rotation, as for example, in the order of about one degree (1°). Accordingly, the mechanism of this invention comprises a housing with axially spaced end walls and a peripheral wall interconnecting the end walls to form a multi-lobe cavity therebetween. A shaft having an eccentric portion is supported for rotation by said housing. A rotor is mounted on the eccentric portion of the shaft for planetative rotary movement within said cavity relative to the housing. The rotor has a plurality of flank surfaces which intersect each other to form a rotor profile of hypotrochoidal configuration with rounded apex portions. The housing cavity has a peripheral surface which has a configuration that is substantially parallel to the outer envelope traced by the rotor apices. The rotor apices are in close running-fit with the housing inner surface to form a plurality of working chambers which expand and contract in volumetric size as the rotor rotates relative to the housing. The housing is provided with inlet and outlet port means on opposite sides of each lobe juncture for passage of low and high pressure fluid from the working chambers. A first gear means is fixedly mounted on the housing. A second gear means is mounted on the rotor for conjoined rotation with the rotor and in meshing relationship with the first gear means to provide a rotor apexes path of substantially the same profile as the housing cavity but angularly displaced to provide a closer running-fit of the apex portions in the locations of the rotor trace of greatest differential pressure between adjacent working chambers.

BRIEF DESCRIPTION OF THE DRAWINGS

The invention will be more fully understood from the following description when considered in connection with the accompanying drawing in which.

DESCRIPTION OF A PREFERRED EMBODIMENT

Figure 1:
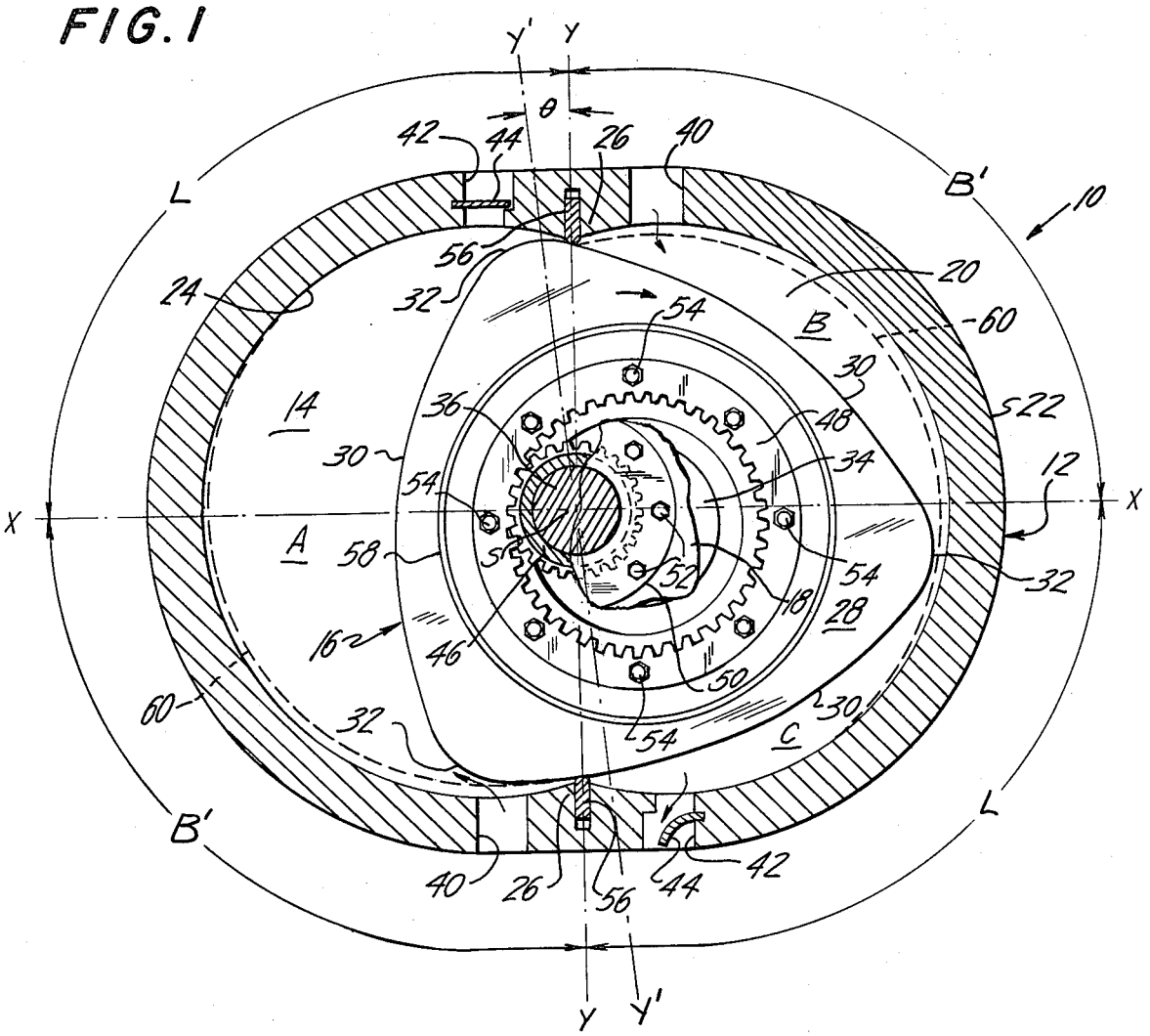
FIG. 1 is a cross-sectional view of the rotary compressor of this invention with the meshing timing gears shown schematically in FIG. 2.
Figure 2:
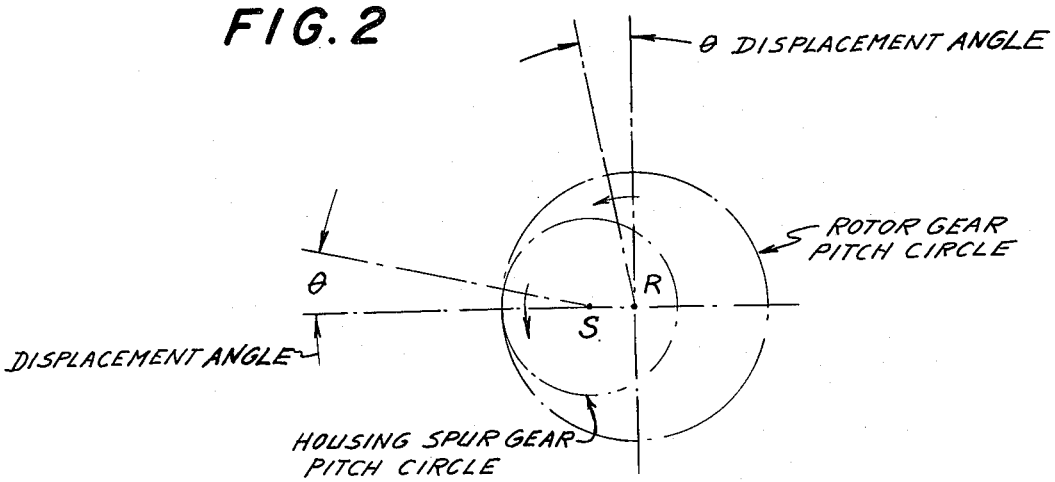
FIG. 2 is a schematic drawing showing the pitch circles of the meshing timing gear of a rotary compressor according to this invention.

Now referring to the drawings and more particularly to FIG. 1, the reference number 10 generally designates the rotary compressor of the Maillard type according to the present invention. The rotary compressor comprises a housing 12, having a cavity 14 of two lobes with a rotor 16 of generally triangular profile.

The housing 12 has end walls 18 and 20 abutting opposite ends of a peripheral wall 22, the walls being suitably secured together by means, such as by tie bolts and dowels (not shown), to form the multi-lobe housing cavity 14. The peripheral wall 22 has a surface 24 conforming substantially in shape to the trace of a hypotrochoidally generated outer envelope of the plural lobe type. As illustrated, the cavity is of the two-lobe type with junctures of the lobes located at 26.

The rotor 16 of the compressor 10 comprises a body portion having opposite, substantially parallel side faces 28 (only one of which is shown) and three peripheral surfaces or flanks 30. The three flanks converge at opposite ends to give the rotor the generally triangular profile. The area of convergence of the flanks 30 form apex or nose portions 32. The peripheral configuration of rotor 16 is a line substantially parallel to the inner envelope of a hypotrochoid. In the case of a rotary piston mechanism of the hypotrochoidal type, as shown in the Maillard British Pat. No. 583,035, data Dec. 5, 1946, the apex or nose portions 32 have a relatively blunt-round configuration. The rotor 16 is supported for planetary rotative movement in cavity 14 by an eccentric portion 34 of a crankshaft 36 which, in turn, is thereto. Various changes can be made in the arrangement of parts without departing from the spirit and scope of the invention as the same will now be understood by those skilled in the art.

What is claimed is:

1. A rotary compressor or expansion engine comprising (a) a housing with axially spaced end walls and a peripheral wall interconnecting the end walls to form a housing cavity therebetween;

(b) a shaft having an eccentric portion supported for rotation in said housing cavity;

(c) a rotor mounted on said eccentric portion for planetative rotary movement within said housing cavity relative to said housing;

(d) said rotor having three flank surfaces intersecting each other to form a profile of hypotrochoidal configuration with rounded apex portions;

(e) said housing cavity having a peripheral surface which is substantially the outer envelope traced by the apexes of the rotor upon rotative movement of the rotor and thereby forming two juxtaposed lobe junctures dividing the housing cavity into a two lobe cavity;

(f) the rotor being sized so that the rotor and its rounded apex portions are in close running-fit with the housing to form a plurality of working chambers which expand and contract in volumetric size as the rotor rotates relative to the housing;

(g) inlet and outlet port means in said housing on opposite sides of each of the lobe junctures for passage of low and high pressure fluid into and from the working chambers and so that in each housing cavity lobe there is a location of greatest differential fluid pressure between next adjacent working chambers;

(h) a first gear means fixedly mounted on said housing; and (i) a second gear means mounted on said rotor for conjoined rotation with said rotor and in meshing relationship with said first gear means to provide a rotor path of substantially the same profile as the housing cavity peripheral surface but angularly displaced to provide a closer running-fit of the apex portion in each housing cavity lobe at the location of greatest differential pressure between next adjacent working chambers.

2. The apparatus of claim 1 wherein the angular displacement of said first and second gear means is in the order of about one (1°) degree.

* * * * *